US008230681B2

(12) United States Patent
Kobayashi et al.

(10) Patent No.: US 8,230,681 B2
(45) Date of Patent: Jul. 31, 2012

(54) EXHAUST GAS SWITCHING VALVE

(75) Inventors: Takashi Kobayashi, Okazaki (JP); Osamu Shimane, Kariya (JP); Koji Hashimoto, Anjo (JP)

(73) Assignee: Denso Corporation, Kariya (JP)

( * ) Notice: Subject to any disclaimer, the term of this patent is extended or adjusted under 35 U.S.C. 154(b) by 548 days.

(21) Appl. No.: 12/406,373

(22) Filed: Mar. 18, 2009

(65) Prior Publication Data

US 2009/0235654 A1 Sep. 24, 2009

(30) Foreign Application Priority Data

Mar. 21, 2008 (JP) ..... 2008-074111

(51) Int. Cl.

| | |
|---|---|
| ***F01N 1/00*** | (2006.01) |
| ***F01N 3/02*** | (2006.01) |
| ***F01N 5/02*** | (2006.01) |
| ***F02M 25/06*** | (2006.01) |
| ***F02M 25/07*** | (2006.01) |
| ***F02B 47/08*** | (2006.01) |

(52) U.S. Cl. ..... 60/324; 60/278; 60/320; 123/568.12

(58) Field of Classification Search ..... 123/568.29, 123/568.12; 60/278, 324, 298, 320, 321; 137/625.29

See application file for complete search history.

(56) References Cited

U.S. PATENT DOCUMENTS 6,141,961 A * 11/2000 Rinckel ..... 60/288
7,438,062 B2 10/2008 Okawa et al.

FOREIGN PATENT DOCUMENTS

| | | |
|---|---|---|
| EP | 1 426 604 | 6/2004 |
| JP | 2004-190693 | 7/2004 |
| JP | 2006-037773 | 2/2006 |
| JP | 2007-100566 | 4/2007 |
| WO | WO 2006/084867 | 8/2006 |
| WO | WO2006084867 A1 * | 8/2006 |

OTHER PUBLICATIONS

Chinese Office Action dated Aug. 12, 2010, issued in corresponding Chinese Application No. 200910128229.2, with English translation.
Japanese Office Action dated Feb. 23, 2010, issued in corresponding Japanese Application No. 2008-074111, with English translation.

* cited by examiner

*Primary Examiner* — Thomas Denion
*Assistant Examiner* — Audrey K Bradley
(74) *Attorney, Agent, or Firm* — Nixon & Vanderhye PC

(57) ABSTRACT

A partition wall partitioning a cooler inlet port and a cooler outlet port extends from a cooler connecting surface of a connecting portion to a vicinity of a shaft supporting a four-way butterfly valve. An EGR gas leakage around a first valve plate can be restricted. Thus, an increase in temperature of EGR gas flowing through an EGR gas outlet port can be restricted at a cooled mode. A deterioration of emission reducing performance can be avoided.

11 Claims, 3 Drawing Sheets

EXHAUST GAS SWITCHING VALVE

CROSS-REFERENCE TO RELATED APPLICATION

This application is based on Japanese Patent Application No. 2008-74111 filed on Mar. 21, 2008, the disclosure of which is incorporated herein by reference.

FIELD OF THE INVENTION

The present invention relates to an exhaust gas switching valve provided in an exhaust gas recirculation system. The exhaust gas switching valve switches between a cold mode (cooler mode) in which the exhaust gas flows through an exhaust gas cooler and a hot mode (bypass mode) in which the exhaust gas bypasses the exhaust gas cooler.

BACKGROUND OF THE INVENTION

An exhaust gas recirculation system (EGR system) has been well known. The EGR system is provided with an exhaust gas cooler (EGR cooler) cooling the recirculated exhaust gas with engine coolant. A combustion temperature is decreased without deteriorating an output of an internal combustion engine, so that noxious agents, such as NOx, contained in the exhaust gas are reduced.

Further, when the engine is at starting state or when an engine coolant temperature is very low in winter, the exhaust gas bypasses the EGR cooler to improve a combustion state of the engine. FIG. 6 shows a conventional EGR system described in WO-2006-084867A1. The EGR system is provided with an EGR cooler 101 cooling an exhaust gas recirculating from an exhaust passage to an intake passage. The recirculated exhaust gas is referred to as an EGR gas. The EGR system is further provided with an exhaust gas switching valve 102 which switches between a cooler-mode and a bypass-mode in order to reduce emission and stabilize a combustion state of the engine. The EGR cooler 101 includes first passages 111 and second passages 113 which are arranged in parallel. The first passages 111 and the second passages 113 are fluidly connected to each other through an intermediate tank 112.

An exhaust gas switching valve 102 is comprised of a housing 103 and a valve body 104. The housing 103 includes an EGR gas inlet port 121 communicating to the exhaust passage of the engine, a cooler inlet port 122 communicating to an inlet of the EGR cooler 101, a cooler outlet port 123 communicating to an outlet of the EGR cooler 101, and an EGR gas outlet port 124 communicating to the intake passage of the engine. The valve body 104 is rotatably accommodated in the housing 103 to switch a communicating condition between the ports 121, 122, 123, 124. The housing 103 includes a shaft supporting portion which supports a shaft 105 of the valve body 104. The valve body 104 is a cantilever valve.

When it is the cooler mode, as shown in FIG. 6, a first EGR gas passage 131 connecting the EGR gas inlet port 121 and the cooler inlet port 122, and a second EGR gas passage 132 connecting the cooler outlet port 123 and the EGR gas outlet port 124 are defined in the housing 103. The EGR gas flows through the EGR cooler 101, so that the temperature of the EGR gas is decreased. When it is the bypass mode, a bypass passage 133 connecting the EGR gas inlet port 121 and the EGR gas outlet port 124 is defined in the housing 103. The EGR gas bypasses the EGR cooler 101.

In the above conventional exhaust gas switching valve 102, in order to drive the valve body 104 stably at any temperature and absorb an assembly tolerance, there is provided valve clearances between an inner surface of the housing 103 and side surfaces of the valve body 104. When it is the cooler mode, a differential pressure between upstream and downstream of the EGR cooler 101 is applied to the valve body 104. The EGR gas flowing through the first EGR gas passage 131 may leak into the second EGR gas passage 132 through the valve clearances.

If the hot EGR gas leaks into the second EGR gas passage 132, the hot EGR gas is mixed with the cooled EGR gas, so that the temperature of the EGR gas flowing into the intake passage through the EGR gas outlet port 124 is increased. Thus, the cooling efficiency of the EGR gas is decreased and the emission reducing performance is deteriorated. Although it is considerable that the valve clearances are made smaller to restrict a leakage of the hot EGR gas, the valve clearances are not easily made smaller due to tolerances of parts and differences in linear expansion coefficient.

The exhaust gas contains exhaust particulates, such as combustion residua or soot. The exhaust particulates become adhesive deposits and may accumulate on the inner surface of the housing 103. When the exhaust gas switching valve 102 is switched from the cooler mode to the bypass mode, the valve body 104 may be stuck by the adhesive deposit.

If the valve clearance is made smaller, the valve body is easily stuck by the adhesive deposit.

SUMMARY OF THE INVENTION

The present invention is made in view of the above matters, and it is an object of the present invention to provide an exhaust gas switching valve capable of restricting a hot EGR gas leakage which causes an increment in temperature of exhaust gas, thereby restricting a deterioration of an emission reducing performance.

According to the present invention, an exhaust gas switching valve includes: a housing having four gas ports which respectively communicate to an exhaust passage, an intake passage, an inlet of an exhaust gas cooler, and an outlet of the exhaust gas cooler; and a valve rotatably accommodated in the housing to switch a communicating condition of the ports. A partition wall partitions the cooler inlet port and the cooler outlet port. The partition wall extends from the connecting portion of the housing and the exhaust gas cooler to a vicinity of a valve shaft. Therefore, an increase in temperature of the exhaust gas flowing out from the exhaust gas outlet port at cooler mode and an increase in temperature of the cooled exhausted gas passed through the exhaust gas cooler can be restricted, so that deterioration of the emission reducing performance can be avoided.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

[First Embodiment]

[Structure of First Embodiment]

Figure 1:
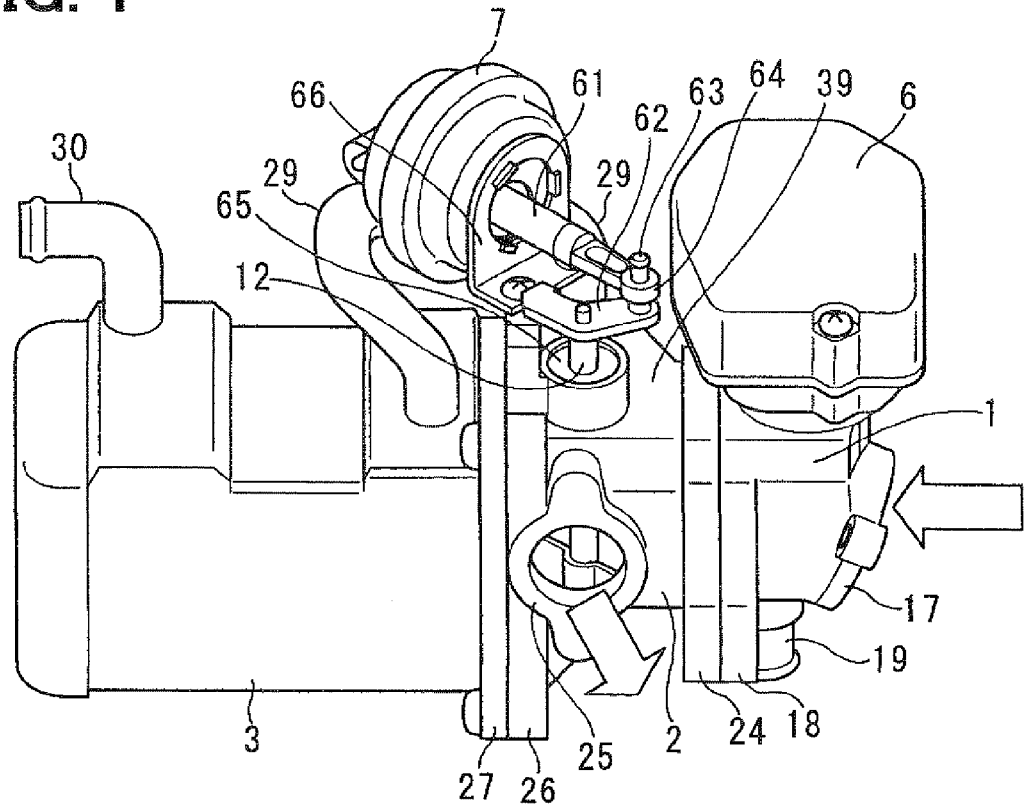
FIG. 1 is a perspective view showing an EGR cooler module according to a first embodiment.

FIGS. 1 to 4 show a first embodiment of the present invention, FIG. 1 shows an EGR cooler module.

In the present embodiment, an exhaust gas recirculation system (EGR system) is provided with an exhaust gas recirculation pipe (EGR pipe) and the EGR cooler module connected to the EGR pipe. A part of exhaust gas of a diesel engine is recirculated from an exhaust passage to an intake passage. The EGR cooler module includes an EGR gas cooling apparatus which cools the EGR gas recirculating from the exhaust passage to the intake passage. Further, the EGR cooler module includes an EGR gas controlling apparatus which controls EGR gas quantity and EGR gas temperature.

Figure 2:
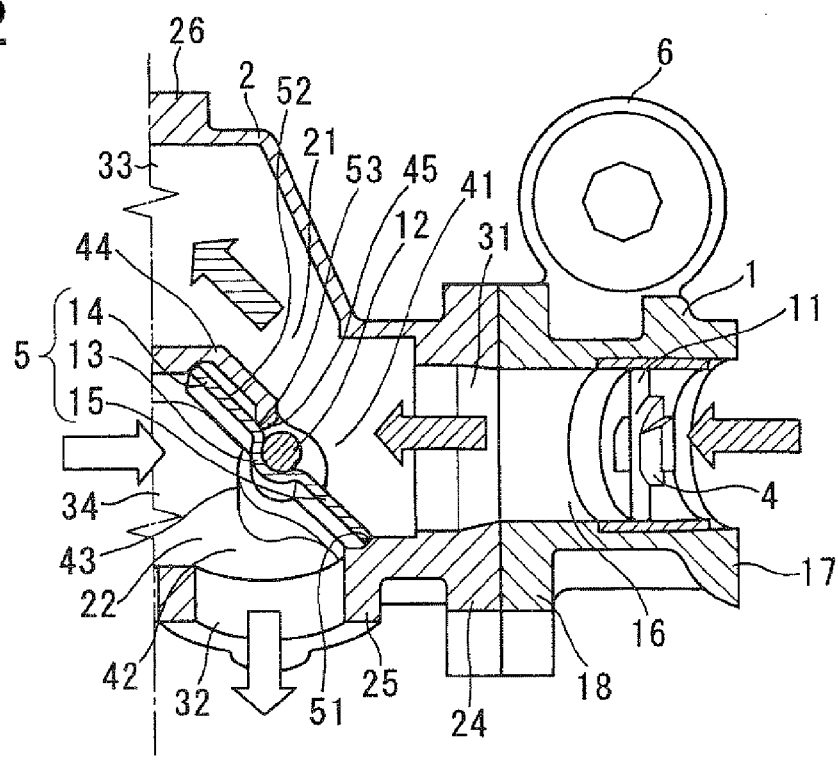
FIG. 2 is a cross sectional view of the EGR cooler module to show a flow of EGR gas at a cooled mode according to the first embodiment.
Figure 3:
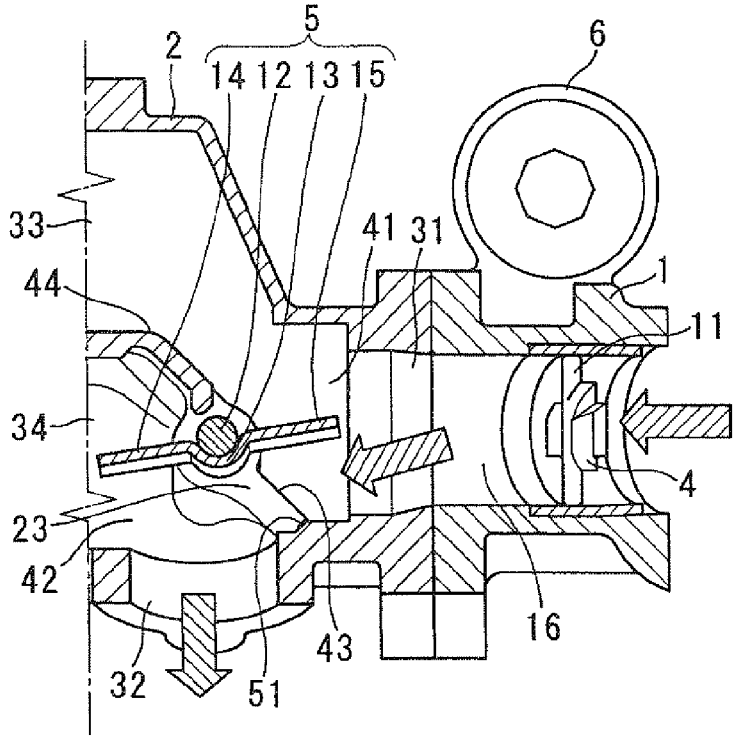
FIG. 3 is a cross sectional view of the EGR cooler module to show a flow of EGR gas flow at a hot mode according to the first embodiment.

The EGR cooler module includes a first housing 1 accommodating a first control valves a second housing 2 accommodating a second control valve (EGR gas temperature control valve), and an EGR cooler 3. The first control valve controls the EGR gas quantity, and the second control valve controls the EGR gas temperature. As shown in FIGS. 2 and 3, a single EGR gas passage 16 is defined in the first housing 1. When it is a cooled mode as the cooler mode, a first EGR gas passage 21 and a second EGR gas passage 22 are defined in the second housing 2 as shown in FIG. 2, When it is a hot mode as the bypass mode, a bypass passage 23 is defined in the second housing 2 as shown in FIG. 3.

The first and the second EGR gas passage 21, 22 are main passage for recirculating the EGR gas from the exhaust passage to the intake passage through the EGR cooler 3. The bypass passage 23 is a bypass passage for the EGR gas to bypass the EGR cooler 3, so that the EGR gas flows from the exhaust passage to the intake passage.

The first control valve controls the EGR gas quantity flowing through the EGR gas passage 16 in the first housing 1. The first control valve includes a first control valve body 4 arranged in the EGR gas passage 16. The first control valve body 4 is rotatably supported by a first shaft 11. A first actuator 6 driving the first control valve body 4 is mounted on the first housing 1. The first actuator 6 includes an electric motor and a mechanical reduction gear transmitting a driving force of the electric motor to the first shaft 11.

The first housing 1 is made from metallic material such as aluminum alloy. The first housing 1 is connected to an intermediate portion of the EGR pipe. The first housing 1 has a cylindrical connecting portion 17 and a square-tubular connecting portion 18. The cylindrical connecting portion 17 has a first connecting surface which is connected to the EGR pipe. The square-tubular connecting portion 18 has a second connecting surface which is connected to the second housing 2. A coolant inlet pipe 19 is connected to the first housing 1. The first housing 1 has a coolant passage around the EGR gas passage 16. The engine coolant is introduced into the coolant passage through the coolant inlet pipe 19.

The exhaust gas switching valve corresponds to the second control valve provided in the second housing 2 in order to control the EGR gas temperature. The exhaust gas switching valve includes a four-way butterfly valve 5 which switches the cooled (cooler) mode and the hot (bypass) mode, The four-way butterfly valve 5 is rotatably supported by a second shaft 12. The four-way butterfly valve 5 is driven by a second actuator 7 mounted on the second housing 2.

The second housing 2 has a square-tubular connecting portion 24, a cylindrical connecting portion 25, and a square-tubular connecting portion 26. The square-tubular connecting portion 24 has a first connecting surface which is connected to the second connecting surface of the first housing 1. The cylindrical connecting portion 25 has a second connecting surface which is connected to the EGR pipe. The square-tubular connecting portion 26 has a connecting surface which is connected to a connecting portion 27 of the EGR cooler 3. The second housing 2 is provided with an intermediate connecting pipe 29 through which the engine coolant in the second housing 2 flow in to the EGR cooler 3. A valve unit is comprised of the first control valve and a second control valve.

Figure 6:
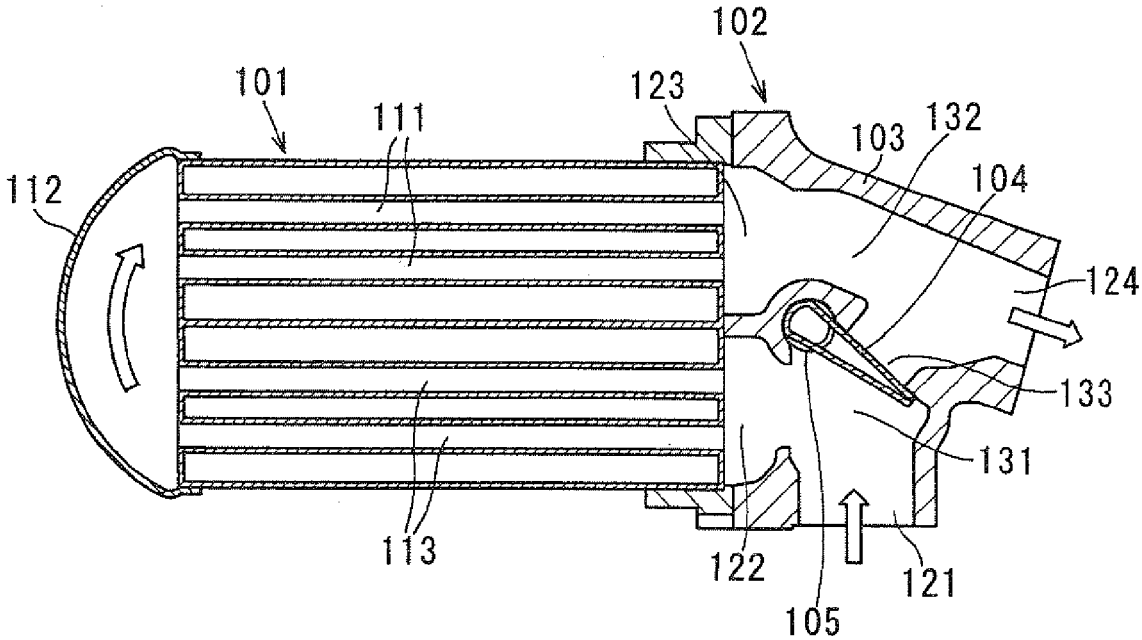
FIG. 6 PRIOR ART
FIG. 6 is a cross sectional view showing a conventional exhaust gas cooling apparatus.

The EGR cooler 3 cools the EGR gas by heat exchanging with the engine coolant. The EGR cooler 3 has a casing and a plurality of flat tubes. An inner fin is arranged inside of each flat tube. The other structure of the EGR cooler 3 is almost the same as the conventional EGR cooler shown in FIG. 6.

An interior of the EGR cooler 3 is divided into a first core portion and a second core portion. An inlet tank, an outlet tank, and an intermediate tank are defined in the casing of the EGR cooler 3. The EGR cooler 3 is provided with a plurality of coolant passages around the flat tubes. The engine coolant recirculates in the coolant passages. The casing has the connecting portion 27 which is connected to the connecting portion 26 of the second housing 2.

The intermediate connecting pipe 29 is connected to the casing of the EGR cooler 3 in order to introduce the engine coolant to the coolant passages. Further, an outlet pipe 30 is connected to the casing of the EGR cooler 3 in order to discharge the engine coolant from the EGR cooler 3. The EGR cooler 3 is fastened to the second housing 2 by use of a plurality of bolts (not shown) with the connecting portion 27 tightly engaged with the connecting portion 26. A sealing member, such as a gasket or a packing, may be provided between the connecting portion 26 and the connecting portion 27.

Referring to FIGS. 1 to 3, an embodiment of the exhaust gas switching valve will be described in detail, hereinafter, The exhaust gas switching valve includes the housing 2, the four-way butterfly valve 5, the shaft 12, and the second actuator 7. The housing 2 has four exhaust gas ports 31-34. The four-way butterfly valve 5 is rotatably accommodated in the housing 2 in such a manner as to switch the communication condition between four exhaust gas ports 31-34. The shaft 12 supports the four-way butterfly valve 5. The second actuator 7 generates a driving force driving the four-way butterfly valve 5. The second housing 2 is made from metallic material such as aluminum alloy.

The exhaust gas ports 31-34 respectively communicate to the exhaust pipe, the intake pipe of the engine, and the inlet tank, the outlet tank of the EGR cooler 3. The first to fourth exhaust gas ports 31-34 corresponds to an EGR gas inlet port 31 communicating to the exhaust pipe of the engine, an EGR gas outlet port 32 communicating to the intake pipe of the engine, a cooler inlet port 33 communicating to the inlet tank of the EGR cooler 3, and a cooler outlet port 34 communicating to the outlet tank of the EGR cooler 3. The EGR gas inlet port 31 opens at the first connecting surface of the connecting portion 24. The EGR gas outlet port 32 opens at the second connecting surface of the connecting portion 24. The cooler inlet port 33 and the cooler outlet port 34 open side by side at the cooler connecting surface of the connecting portion 26.

The first EGR gas passage 21, as shown in FIG. 2, fluidly connects the EGR gas inlet port 31 to the cooler inlet port 33, and introduces the hot EGR gas in the second housing 2 into the EGR cooler 3. The second EGR gas passage 22, as shown in FIG. 2, fluidly connects the cooler outlet port 34 to the EGR gas outlet port 32 to the cooler inlet port 33, and introduces the cooled EGR gas in the second housing 2 into the intake pipe of the engine. The second EGR gas passage 22 is inclined with respect to a center line of the cooler outlet port 34.

The bypass passage 23 connects the EGR gas inlet port 31 to the EGR gas outlet port 32, as shown in FIG. 3. The hot EGR gas flows through the bypass passage 23 to bypass the EGR cooler 3 and flows into the intake pipe of the engine. The second housing 2 is comprised of an upper housing 39 and a lower housing 39. The upper and lower housings 39 are engaged to define a valve chamber therein. The valve chamber accommodates the four-way butterfly valve 5. The upper and lower housings 39 have a first recess 41 and a second recess 42 between inner surfaces of the upper and lower housings 39 and the four-way butterfly valve 5 positioning at a position other than the cooling position. The first recess 41 and the second recess 42 form a second clearance between the inner surfaces of the housings 39. The second clearance is larger than a first clearance which will be described later. A convex protrusion 43 is formed between the first recess 41 and the second recess 42. The convex protrusion 43 extends from the inner surfaces of the upper and lower housings 39 toward the valve chamber.

The second housing 2 has a partition wall 44 which partitions the cooler inlet port 33 and the cooler outlet port 34. The partition wall 44 extends from a cooler connecting surface of the connecting portion 26 to a vicinity of the shaft 12 of the four-way butterfly valve 5. The partition wall 44 is comprised of a straight portion and an inclined portion. The straight portion of the partition wall 44 is aligned with a center plane of the EGR cooler 3, which partitions the core portion of the EGR cooler 3 into the first core portion and the second core portion. The inclined portion is inclined with respect to the straight portion toward the second EGR gas passage 22. The partition wall 44 has a protrusion 45 which protrudes toward the butterfly valve 5.

The four-way butterfly valve 5 is made of metallic material, such as stainless steel. The four-way butterfly valve 5 is rotatably accommodated in the valve chamber of the second housing 2. The four-way butterfly valve 5 pivots on the shaft 12 to change a communication condition between each gas ports 31-34. The four-way butterfly valve 5 can continuously adjust opening degrees of the first and second EGR gas passages 21, 22, and the bypass passage 23 so that a mixing ratio between a cooled EGR gas passed through the EGR cooler 3 and a hot EGR gas passed through the bypass passage 23 can be suitably varied. Thus, the temperature of the EGR gas recirculated to the intake pipe can be controlled.

During the cooled mode, as shown in FIG. 2, the four-way butterfly valve 5 has a function of a partition wall which partitions the interior of the second housing 2 into the first EGR gas passage 21 and the second EGR gas passage 22. During the hot mode, as shown in FIG. 3, the four-way butterfly valve 5 has a function of a partition wall which partitions the interior of the second housing 2 into the bypass passage 23, the cooler inlet port 33 and the cooler outlet port 34.

The four-way butterfly valve 5 continuously rotates from a bypass-full-closed position to a bypass-full-opened position. At the bypass-full-closed position, the quantity of the cooled EGR gas becomes maximum value. At the bypass-full-opened position, the quantity of the hot EGR gas becomes maximum value. The four-way butterfly valve 5 is a square-shaped butterfly valve having the shaft 12, a center portion 13 supported by the shaft 12, a first valve plate 14 and a second valve plate 15.

The center portion 13 is arch-shaped and fixed to a valve holding portion of the shaft 12 in such a manner as to surrounds the valve holding portion. The first and second valve plates 14, 15 are square-shaped, and extend in a radial direction of the shaft 12 from the center portion 13. An area ratio between the first valve plate 14 and the second valve plate 15 can be set as 10:2-10:10. In the present embodiment, the area of the first valve plate 14 is equal to the area of the second valve plate 15.

The second housing 2 has an opening 51 which is closed by the second valve plate 15 at the cooled mode. Between a periphery of the second valve plate 15 and an inner periphery of the opening 51, the first clearance is formed in order that the four-way butterfly valve 5 can smoothly rotate in the valve chamber of the second housing 2 without receiving any adverse affect due to manufacturing tolerances and a difference in thermal expansion coefficient.

The first valve plate 14 has an overlap portion 52 which overlaps the partition wall 44 at the cooled mode. The area ratio between the first valve plate 14 and the overlap portion 52 is set as 10:9-10:10. The overlap portion 52 has a contacting portion 53 which is brought into contact with the protrusion 45 at the cooled mode. A contacting position of the contacting portion 53 and the protrusion 45 is close to the shaft 12. The protrusion 45 is in contact with the contacting portion 53 by a surface contact or a line contact of a surface and an edge. In the present embodiment, the protrusion 45 is in contact with the contacting portion 53 in a direction parallel to the shaft 12 along a valve width. The protrusion 45 is a valve seat for the first valve plate 14 at the cooled mode. At the cooled mode, the partition wall 44 and the overlap portion 52 form a double wall structure. As illustrated in FIG. 2, a gap clearance space is defined between the partition wall 44 and the overlap portion 52 at the cooled mode.

The shaft 12 is made of metallic material, such as stainless steel. The shaft 12 penetrates the second housing 2. The butterfly valve 5 is connected to one end of the shaft 12, and a second actuator 7 is connected to the other end of the shaft 12. The second actuator 7 is a negative pressure valve generating driving force by means of negative pressure. The second actuator has a rod 61 extending straight. The rod 61 is connected to a link plate 62 which converts a linear motion of the rod 61 into a rotational motion of the shaft 12. The link plate 62 has a pin 63 at its end, and the rod 61 has an engaging portion 64 at its end. The pin 63 is engaged with the engaging portion 64. The end portion of the shaft 12 projecting from a plug 65 is connected to a middle portion of the link plate 62.

The second actuator 7 has a diaphragm which defines a negative pressure chamber and an atmospheric pressure chamber. A spring biasing the diaphragm to one direction is accommodated in the second actuator 7. A negative pressure introducing pipe is connected to the negative pressure chamber in order to introduce negative pressure into the negative pressure chamber from an electric vacuum pump through a negative pressure control valve.

The diaphragm is displaced in its thickness direction so that the rod 61 moves in its axial direction. The movement of the rod 61 is transferred to the shaft 12 through the link plate 62, whereby the shaft 12 rotates by a specified rotational angel. The four-way butterfly valve 5 changes its valve position. The second actuator 7 is fixed on the upper housing 39 through a bracket 66.

The electric motor of the first actuator 6, the negative pressure control valve and the vacuum pump of the second actuator 7 are electrically controlled by an electronic control unit (ECU). The ECU includes a microcomputer comprised of a central processing unit (CPU), a read only memory (ROM), a random access memory (RAM), an input circuit, and an output circuit.

When an ignition switch is turned on, the ECU controls the first control valve body 4 and the four-way butterfly valve 5 according to control programs stored in the memories. Sensor signals from each sensor are inputted into the microcomputer after A/D conversion. A crank angle sensor, an accelerator position sensor, a coolant temperature sensor, an intake air temperature sensor, an EGR gas quantity sensor, and an EGR gas temperature sensor are connected to the microcomputer.

[Operation of First Embodiment]

Referring to FIGS. 1 to 3, an operation of the EGR cooler module will be briefly described hereinafter.

When the ignition switch is turned on to start the engine, the ECU feedback controls electric power supplied to the electric motor of the first actuator 6 in such a manner that the actual EGR quantity agrees with a target EGR quantity. When the electric motor is energized, the driving force of the motor is transmitted to the shaft so that the first control valve body 4 is drove from a full closed position to an opened position.

The first control valve body 4 is positioned at a specified position corresponding to a target control value. A part of the exhaust gas discharged from the combustion chamber of the engine recirculated from the exhaust pipe to the intake pipe through the first EGR gas passage 21, the EGR cooler 3, the second EGR gas passage 22.

When the engine load is middle or high, the four-way butterfly valve 5 is brought into a cooled position. When the four-way butterfly valve 5 is switched to the cooled position, the interior of the second housing 2 is switched into the cooled mode. During the cooled mode, as shown in FIG. 2, the exhaust gas is recirculated to the intake pipe through the EGR gas inlet port 31, the first EGR gas passage 21, the cooler inlet port 33, the EGR cooler 3 (the inlet tank, the first core portion, the middle tank, the second core portion, and the outlet tank), the cooler outlet port 34, the second EGR gas passage 22, and the EGR gas outlet port 32.

The EGR gas is cooled by the EGR cooler 3, and then mixed with the intake air in the intake pipe. The cooled EGR gas is of low temperature and low density. Thereby, the combustion temperature is decreased without deteriorating the output of the engine. The quantity of harmful materials, such as NOx, contained in the exhaust gas can be reduced. Further, since the recirculated EGR gas is cooled by the EGR cooler 3, the filling efficiency of the EGR gas into the engine is improved and the emission reducing performance is enhanced.

When the engine load is low, or when the engine is at idling state, the four-way butterfly valve 5 is brought into a hot position. When the four-way butterfly valve 5 is switched to the hot position, the interior of the second housing 2 is switched into the hot mode. During the hot mode, as shown in FIG. 3, the exhaust gas is recirculated to the intake pipe through the EGR gas inlet port 31, the bypass passage 23 (the opening 51), and the EGR gas outlet port 32. Thereby, when the engine is idling, the intake air is sufficiently warmed so that the combustibility of the fuel is improved and the generation of hydrocarbon (HC) and white smoke is prevented.

[Advantages of First Embodiment]

According to the first embodiment, the partition wall 44 extends from a cooler fixing surface of the connecting portion 26 to a vicinity of the shaft 12. The first valve plate 14 has the overlap portion 52 which overlaps the partition wall 44 at the cooled mode. Thus, the EGR gas leakage from the first valve plate 14 can be reduced.

Figure 4:
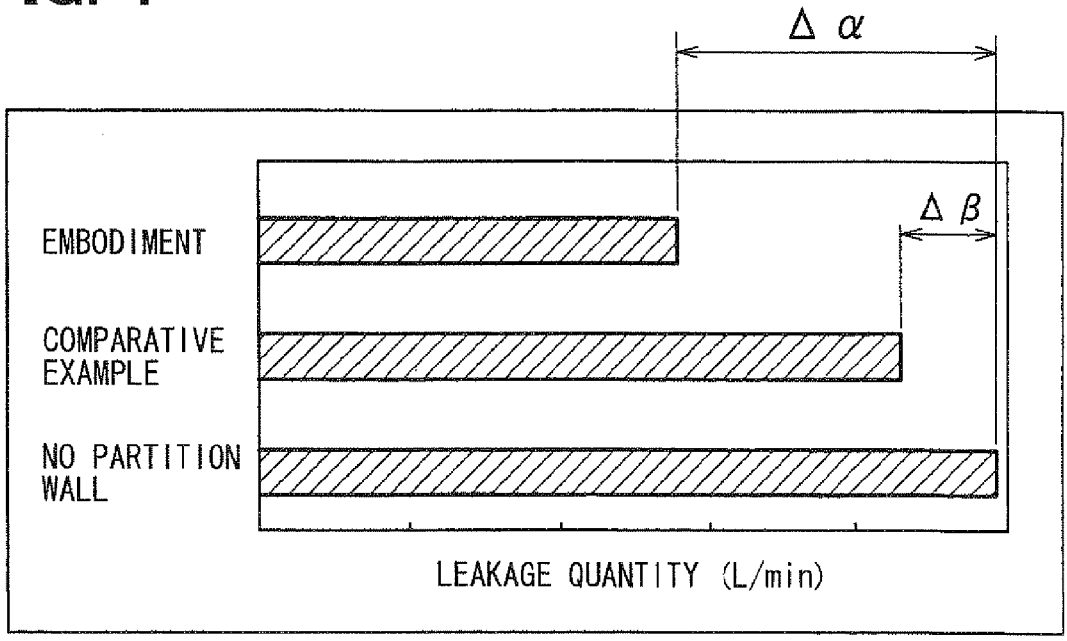
FIG. 4 is a chart showing an experiment result as to an EGR gas leakage.

FIG. 4 shows a leak test result with respect to the exhaust gas switching valve having the partition wall 44 and the protrusion 45 (the first embodiment), an exhaust gas switching valve having the partition wall 44 and no protrusion (a comparative example), and an exhaust gas switching valve having no partition wall. As shown in FIG. 4, a leakage quantity of the EGR gas of the comparative example is less than that of the exhaust gas switching valve having no partition wall by $\Delta\beta L$/min. A leakage quantity in the first embodiment is less than that in the exhaust gas switching valve having no partition wall by $\Delta\alpha L$/min ($>\Delta\beta$).

According to the first embodiment, when the four-way butterfly valve is positioned at the cooled position, the leakage quantity of the EGR gas from the first EGR gas passage 21 to the second EGR gas passage can be reduced. Therefore, an increase in temperature of the exhaust gas flowing out from the EGR gas outlet port 32 and an increase in temperature of the cooled EGR gas passed through the EGR cooler 3 can be restricted, so that deterioration of the emission reducing performance can be avoided.

The area ratio between the first valve plate 14 and the second valve plate 15 is set as 10:2-10:10. In the first embodiment, since the area of the first valve plate 14 is equal to the area of the second valve plate 15, the areas at which the exhaust gas pulsation pressures are received are same in each valve plate 14, 15. Thus, the four-way butterfly valve 5 is stable against the exhaust gas pulsation pressure. The leakage quantity of hot EGR gas from the first EGR gas passage 21 to the second EGR gas passage 22 can be reduced at the cooled mode. Therefore, an increase in temperature of the exhaust gas flowing out from the EGR gas outlet port 32 and an increase in temperature of the cooled EGR gas passed through the EGR cooler 3 can be restricted, so that deterioration of the emission reducing performance can be avoided.

Further, the first valve plate 14 has a contacting portion 53 which is brought into contact with the protrusion 45 of the partition wall 44 at the cooled mode. The contacting position of the protrusion 45 and the contacting portion 53 is formed at a vicinity of the shaft 12. The leakage of hot EGR gas from the first EGR gas passage 21 to the second EGR gas passage 22 can be avoided at the cooled mode.

The first and the second recess 41, 42 are formed on the inside surfaces of the upper and lower housings 39 to define the second clearance between the four-way butterfly valve 5 and the housings 39. Since most of the adhesive deposits are accumulated in the first and the second recess 41, 42, the four-way butterfly valve 5 can easily rotate from the cooled mode to the hot mode without being stuck in the deposits. Thus, an operational defect of the four-way butterfly valve 5 can be avoided.

[Second Embodiment]

Figure 5:
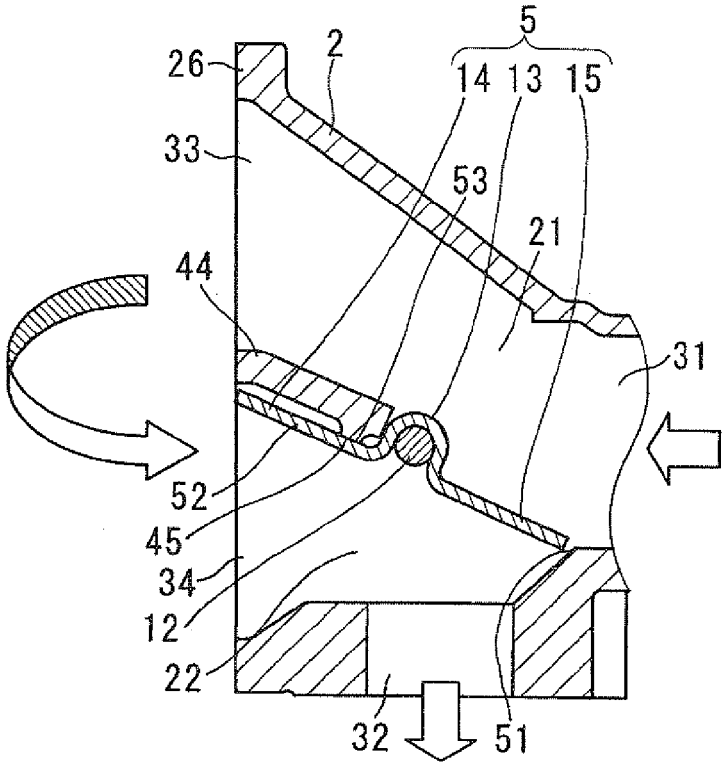
FIG. 5 is a cross sectional view showing an EGR gas flow at a cooled mode according to a second embodiment.

FIG. 5 shows a four-way butterfly valve 5 according to the second embodiment. The four-way butterfly valve 5 is rotatably accommodated in a valve chamber of the housing 2. The second actuator 7 rotates the four-way butterfly valve 5 through the shaft 12.

The partition wall 44 has a protrusion 45 which protrudes toward the butterfly valve 5. The protrusion 45 can be brought into contact with the contacting portion 53 provided on the overlap portion 52 of the first valve plate 14. The protrusion 45 has a flat surface on which the contacting portion 53 is brought into contact. The first valve plate 14, the overlap portion 52, and the contacting portion 53 have flat surfaces confronting to the partition wall 44. The contacting position of the protrusion 45 and the contacting portion 53 is formed at a vicinity of the shaft 12. The protrusion 45 and the contacting portion 53 can be contacted with each other by surface contact at the cooled mode. The protrusion 45 has a function of valve seat for the first valve plate 14. At the cooled mode, the partition wall 44 and the overlap portion of the first valve plate 14 form a double wall structure.

[Modification]

In the above embodiments, the second actuator 7 is a negative pressure valve having a negative pressure control valve and an electric vacuum pump. Alternatively, the second actuator 7 may be an electric actuator or an electromagnetic actuator having an electric motor and a reduction gear mechanism. A spring biasing the four-way butterfly valve 5 to close the bypass passage 23 may be provided in the second housing 2.

The first control valve may be not mounted in the EGR cooler module. The first control valve may be arranged downstream of the EGR cooler 3. In the above embodiments, the EGR cooler 3 is a U-turn flow type. Alternatively, the EGR cooler 3 can be configured in such a manner that the EGR gas flows in S-turn or I-flow. In this case, the outlet tank portion of the EGR gas cooler 3 and the cooler outlet port 34 are connected to each other through a pipe having no function of heat-exchange.

In the above embodiments, the protrusion 45 is integrally formed with the partition wall 44. Alternatively, the protrusion 45 may be formed independently, and then fixed to the partition wall 44. Alternatively, it may be configured that the partition wall 44 and the overlap portion 52 can be contact with each other by a surface contact. At cooler mode, a labyrinth structure may be formed between the partition wall 44 and the overlap portion 52.

What is claimed is:

1. An exhaust gas switching valve comprising:

(a) a housing having four exhaust gas ports which respectively communicate with an exhaust passage of an internal combustion engine, an intake passage of an internal combustion engine, an inlet of an exhaust gas cooler and an outlet of the exhaust gas cooler, and (b) a valve rotatably accommodated in the housing to switch a communicating condition between four exhaust gas ports, wherein according to a rotational angle position of the valve in the housing, the exhaust gas switching valve switches between a cooler mode in which an exhaust gas is introduced into the exhaust gas cooler to be cooled and a bypass mode in which the exhaust gas bypasses the exhaust gas cooler, said four exhaust gas ports correspond to a gas inlet port communicating with the exhaust passage of the internal combustion engine, a gas outlet port communicating with the intake passage of the internal combustion engine, a cooler inlet port communicating with an inlet of the exhaust gas cooler, and a cooler outlet port communicating with an outlet of the exhaust gas cooler, the valve is a butterfly valve including a shaft supported by the housing, a first valve plate and a second valve plate which are respectively connected to both side surfaces of the shaft, the housing includes a first gas passage connecting the gas inlet port to the cooler inlet port, a second gas passage connecting the cooler outlet port to the gas outlet port, a connecting portion connected to the exhaust gas cooler and a partition wall partitioning the cooler inlet port and the cooler outlet port, the partition wall extends from the connecting portion to a vicinity of the shaft, the valve has a center portion supported by the shaft, the first valve plate and the second valve plate are arranged opposite sides relative to the center portion, the first valve plate has an overlap portion which is brought into a contact with the partition wall in the second gas passage at the cooler mode and which overlaps the partition wall in the second gas passage at the cooler mode, the housing has an opening closed by at least the second valve plate at the cooler mode, a contacting position between the first valve plate and the partition wall is arranged at a vicinity of the shaft, the partition wall is arranged upstream of the first valve plate in a flow direction of the exhaust gas introduced from the gas inlet port, and the partition wall and the overlap portion configure a double wall structure with a gap clearance space therebetween at the cooler mode in such a manner that the exhaust gas introduced from the gas inlet port flows toward the cooler inlet port along a surface of the partition wall without contacting with the overlap portion of the first valve plate.

2. The exhaust gas switching valve according to claim 1, wherein the first gas passage and the second gas passage are formed in the housing at the cooler mode.

3. The exhaust gas switching valve according to claim 1, wherein the valve functions as a partition plate partitioning an interior of the housing into the first gas passage and the second gas passage at the cooler mode.

4. The exhaust gas switching valve according to claim 1, wherein the valve is configured in such a manner that an area ratio between the first valve plate and the overlap portion is defined as 10:9-10:10.

5. The exhaust gas switching valve according to claim 1, wherein the partition wall has a protrusion protruding toward the first valve plate, and the protrusion functions as a valve seat of the first valve plate at the cooler mode.

6. The exhaust gas switching valve according to claim 1, wherein an area ratio between the first valve plate and the second valve plate is defined as 10:2-10:10.

7. The exhaust gas switching valve according to claim 1, wherein an area of first valve plate is equal to an area of the second valve plate.

8. The exhaust gas switching valve according to claim 1, wherein the housing has an opening closed by at least the second valve plate at the cooler mode and a housing wall portion, the valve is positioned at a cooled position at the cooler mode so as to close the opening, and the housing wall portion has a recess to form a clearance between the valve and the housing when the valve is positioned at other than the cooled position.

9. The exhaust gas switching valve according to claim 1, wherein the exhaust gas cooler has a casing to define a U-shaped exhaust gas passage therein, and the inlet and the outlet of the exhaust gas cooler are adjacently opened at a housing connecting surface of the casing to which a connecting portion of the housing is connected.

10. The exhaust gas switching valve according to claim 1, wherein the housing has a bypass passage fluidly connecting the gas inlet port to the gas outlet port through the opening.

11. The exhaust gas switching valve according to claim 10, wherein the bypass passage is formed in the housing at the bypass mode.

* * * * *